US006687663B1

(12) United States Patent
McGrath et al.

(10) Patent No.: US 6,687,663 B1
(45) Date of Patent: Feb. 3, 2004

(54) AUDIO PROCESSING METHOD AND APPARATUS

(75) Inventors: David Stanley McGrath, Bondi (AU); Glenn Norman Dickins, Ultimo (AU)

(73) Assignee: Lake Technology Limited, Ultimo (AU)

( * ) Notice: Subject to any disclaimer, the term of this patent is extended or adjusted under 35 U.S.C. 154(b) by 375 days.

(21) Appl. No.: 09/603,877

(22) Filed: Jun. 26, 2000

(30) Foreign Application Priority Data

Jun. 25, 1999 (AU) ..... PQ1223
Jan. 10, 2000 (AU) ..... PQ5014

(51) Int. Cl.[7] ..... G10L 19/00

(52) U.S. Cl. ..... 704/200.1; 704/228; 704/223; 704/227; 704/272; 704/503

(58) Field of Search ..... 704/228, 223, 704/227, 272, 503, 200.1

(56) References Cited

U.S. PATENT DOCUMENTS 5,535,300 A * 7/1996 Hall et al. ..... 704/227
5,884,010 A * 3/1999 Chen et al. ..... 704/228
5,886,276 A * 3/1999 Levine et al. ..... 84/603
5,909,664 A * 6/1999 Davis et al. ..... 704/200.1
6,016,473 A * 1/2000 Dolby ..... 704/500
6,226,608 B1 * 5/2001 Fielder et al. ..... 704/229
6,377,930 B1 * 4/2002 Chen et al. ..... 704/503
6,384,759 B2 * 5/2002 Snyder ..... 341/123
6,421,639 B1 * 7/2002 Yasunaga et al. ..... 704/223
6,424,939 B1 * 7/2002 Herre et al. ..... 704/219
6,477,496 B1 * 11/2002 Case ..... 704/272

OTHER PUBLICATIONS

Chen et al. "fast time–frequency transform algorithms and the application to real–time software implementation AC–3 audio codec", Consumer Electronics, IEEE transaction, vol.: 44,, May 1998, p. 413–423.*
"Digital audio compression standard (AC–3)", Advanced Television System Committee, 1995, p. 50 and 102.*

* cited by examiner

*Primary Examiner*—Richemond Dorvil
*Assistant Examiner*—Qi Han
(74) *Attorney, Agent, or Firm*—Dov Rosenfeld; Inventels

(57) ABSTRACT

A method of creating a compressed audio output signal from a series of input audio signals is disclosed and claimed. In one embodiment, the method may include, for each of the input audio signals a) precomputing a transform corresponding to the desired compression format of the output audio signal. This may be followed by b) precomputing ancillary information relating to the compression of the transformed input audio. Next, the method may include c) mixing together the transformed input signals in the transform domain to produce an output transform domain signal. The method may then include d) algorithmically combining together the precomputed ancillary information to determine a suitable decompression strategy. Lastly, the method may include e) outputting compressed audio data comprising the output transform domain signal and the combined ancillary information.

11 Claims, 9 Drawing Sheets

AUDIO PROCESSING METHOD AND APPARATUS

FIELD OF THE INVENTION

The present invention relates to the mixing and encoding of audio signals and, in particular, to the mixing and encoding of AC-3 signals.

BACKGROUND OF THE INVENTION

Recently, the capture, transmission and processing of digital audio has become increasingly popular. Often, in order to save bandwidth and storage space, the signals are transmitted in a compressed form. One extremely popular form of audio compression is the Dolby AC-3™ transmission format and the MPEG2—level 3 transmission format.

Extensive discussion of the technical aspects of the Dolby transmission format can be found at the Dolby website. In particular, reference is made to:

Steve Vernon, "Design and implementation of AC-3 coders," IEEE Trans. Consumer Electronics, Vol.41, No.3 August 1995.

Mark F. Davis, "The AC-3 Multichannel Coder," Presented at the 95$^{th}$ Convention of the Audio Engineering Society, Oct. 7–10, 1993.

Craig C. Todd, Grant A. Davidson, Mark F. Davis, "AC-3: Flexible Perceptual Coding for Audio Transmission," Presented at the 96$^{th}$ convention of the Audio Engineer society, Feb. 26–Mar. 01, 1994.

Turning to FIG. 1 there is illustrated the standard AC-3 encoding process taken from one of the aforementioned references. In the AC-3 process 1, input samples are firstly frequency domain transformed 2 utilizing a modified discrete cosine transform with a fifty percent overlap. The output is then forwarded to a floating point conversion process which divides the transform coefficients into exponent and mantissa pairs. The mantissas are then quantised 5 with a variable number of bits based on a parametric bit allocation model 6. The exponents and mantissas are packed into a bit stream 7 before being output 8 in an AC-3 format. In a decoding process, the steps are provided in reverse so as to produce output samples.

When it is desired to mix multiple signals together so as to create new output audio signals, the lengthy process of decoding must be undertaken each time with the signals transformed into the time domain and then transformed back into the frequency domain.

It will be desirable to provide a system having lower levels of computational requirements when mixing signals whilst maintaining significant advantages in efficiency of utilisation.

SUMMARY OF THE INVENTION

In accordance with the first aspect of the present invention, there is provided a method of creating an audio output signal from a series of input audio signals, comprising: (a) for each of said series of input audio signals, precomputing corresponding transform domain input audio signals and associated psychoacoustic masking curves for said input audio signals; (b) mixing together said transform domain input signals in the transform domain to produce an output transform domain signal; (c) mixing together said masking curves in the transform domain to produce an output transform domain masking curve; (d) quantizing said output transform domain signal with said output transform domain masking curve; and (e) outputting said quantized output transform domain signal.

Element (b) can include, wherein said mixing together said transform domain input signals includes fading one or more of said transform domain input signals, wherein said fading includes suppressing noise associated with said fading process. The suppressing preferably can include a first order compensation for said noise.

The system can also include transforming in real-time a real-time audio stream and mixing said real-time audio stream with said transform domain input signals in element (b).

The quantized output transform domain signal can be in the format of AC3 encoded data or MPEG audio encoded data.

The audio output signal is created as a series of blocks of data output one at a time and the method preferably can include adaptively determining compression parameters for the output blocks.

In accordance with a further aspect of the present invention, there is provided a method of creating a compressed audio output signal from a series of input audio signals comprising, for each of said input audio signals: a) precomputing a transform corresponding to the desired compression format of said in output audio signal; b) precomputing ancillary information relating to the compression of the transformed input audio; c) mixing together said transformed input signals in the transform domain to produce an output transform domain signal; d) algorithmically combining together said precomputed ancillary information to determine a suitable decompression strategy; and e) outputting compressed audio data comprising said output transform domain signal and said combined ancillary information.

The ancillary information comprises at least one of the following: signal banded power spectrum, exponent groupings or psycho acoustic masking curves. The element (d) preferably can include determining desirable quantization levels of said output transform domain signal.

In accordance with a further aspect of the present invention, there is provided a method of creating a compressed audio output signal from a series of input audio signals comprising, for each of said input audio signals: a) mixing together a series of transformed input signals in the transform domain to produce an output transform domain signal; b) algorithmically combining together precomputed ancillary information to determine a suitable decompression strategy; and c) outputting compressed audio data comprising said output transform domain signal and said combined ancillary information.

In accordance with a further aspect of the present invention, there is provided a single pass AC3 encoder having adaptive processing capabilities. The single pass encoder can efficiently produce an AC3 output in real time. This is to be contrasted with an iterative encoder. The single pass encoder calls upon information from different sources. For example:

Efficiency of previous blocks compression

Precomputed bit allocation information and suggested exponent strategies.

Precomputed audio signal statistics to determine when to change strategies.

Simple real time audio signal statistics to identify change points

Precomputed information from future audio blocks to estimate future bit allocation demand.

Using this information an algorithm which can estimate the strategies and masking curve parameters for the audio data which come close to using all the available bandwidth without exceeding it is provided. Preferably the system provides for balancing the bit allocation load across the 6 audio blocks in a frame and different ways to immediately sacrifice some bit allocations to ensure the available bandwidth is not exceeded.

BRIEF DESCRIPTION OF THE DRAWINGS

Preferred forms of the present invention will now be described with reference to the accompanying drawings in which.

DESCRIPTION OF CERTAIN EMBODIMENTS OF THE INVENTION

In one embodiment, processing is carried out in the frequency domain so as to reduce the computational requirements upon mixing or panning of signals.

Figure 1:
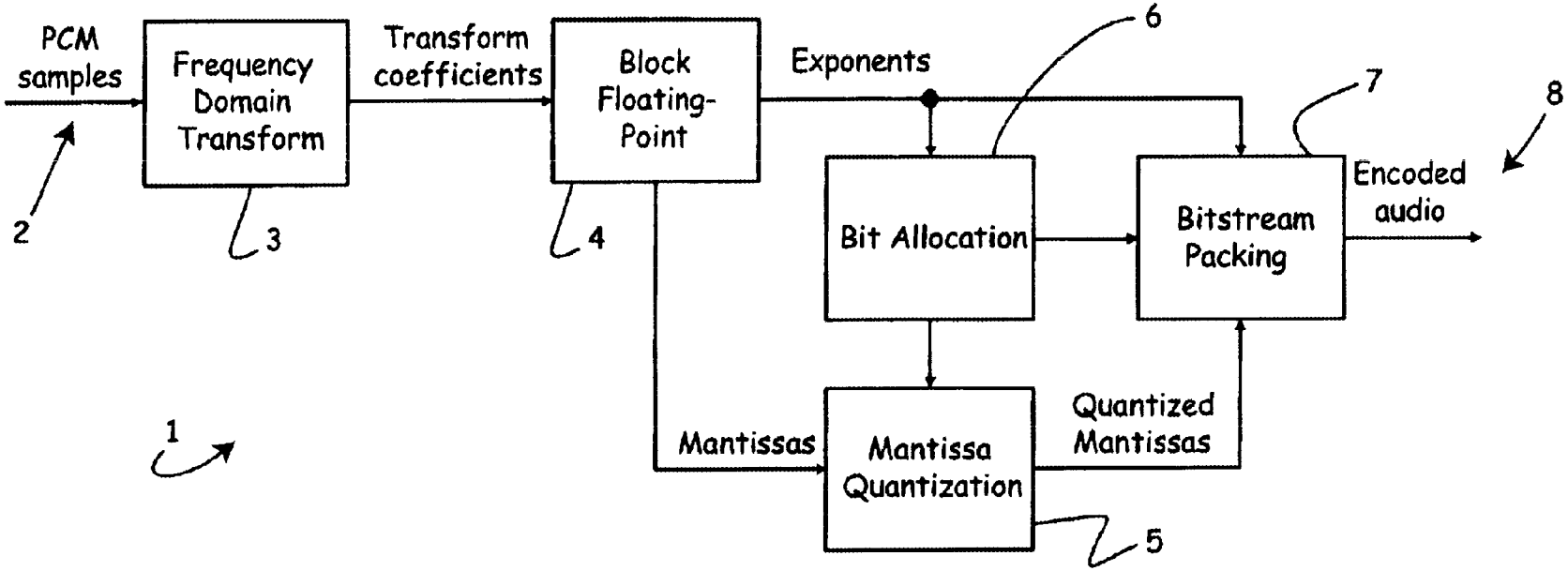
FIG. 1 (PRIOR ART)
FIG. 1 illustrates the standard AC3 decoding algorithm.
Figure 2:
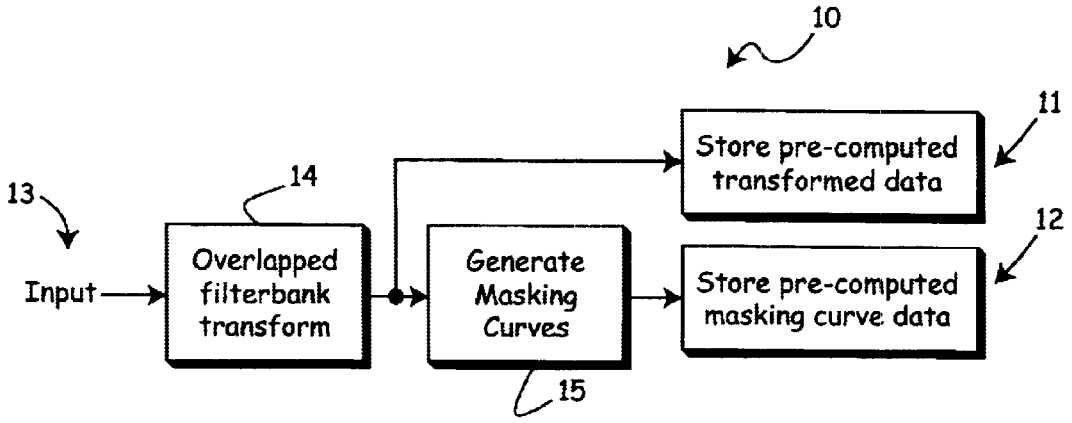
FIG. 2 illustrates the process of pregeneration of audio data into an intermediate format.

As illustrated in FIG. 2, each signal that may form part of an output is preprocessed 10 into an intermediate form and stored as precomputed transform data 11 and precomputed mask data 12. The input signal 13 is initially transformed 14 utilizing the usual modified discrete cosine transform (MDCT) so as to produce frequency domain data A standard AC-3 masking curve is then produced 15 so as to provide for precomputed masking curve data 12 and pre-computed transform data 11.

Figure 3:
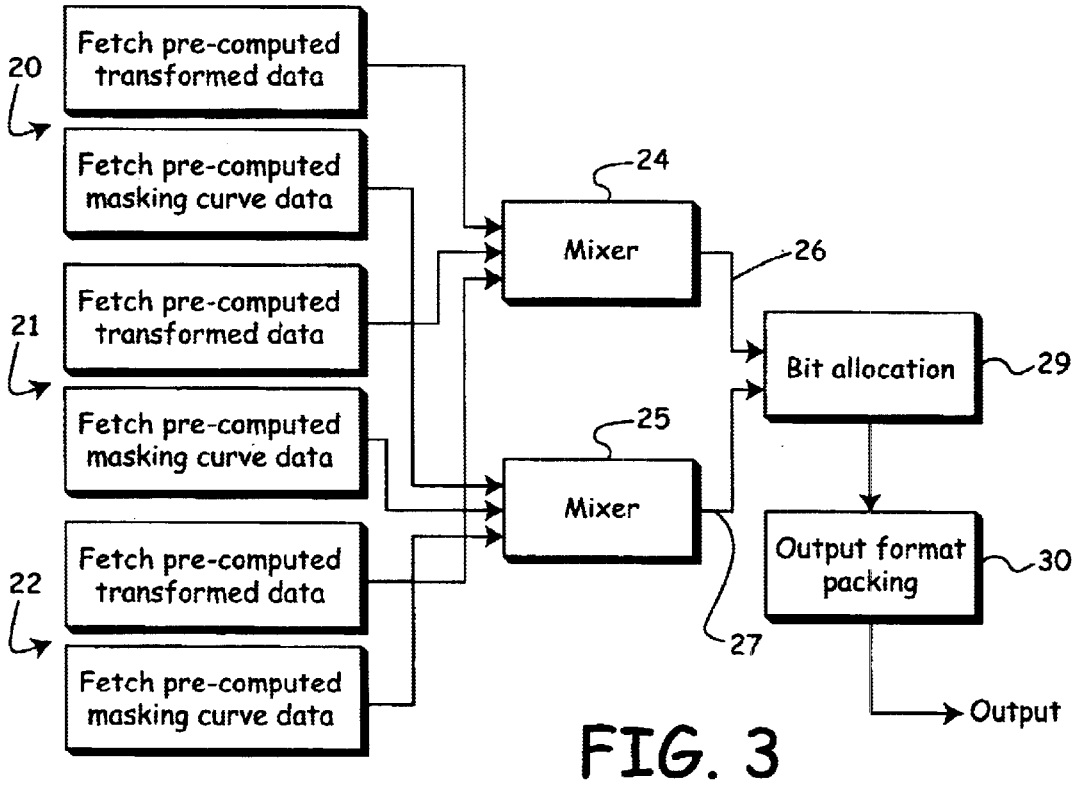
FIG. 3 illustrates a schematic diagram of a process of mixing audio tracks in an intermediate format.

When it is desired to create an output from the mixing of multiple input signals, the operation as illustrated in FIG. 3 is carried out. The sets of pre-computed input signals 20–22 and associated masking data are each forwarded to their own mixer 24, 25 with the signals being mixed in the frequency domain so as to produced mixed frequency domain output data 26 and overall masking profile 27. The masking profile is then utilised with the input data in the usual manner 29 so as to produce suitable output data which is then packed 30 for output as an AC-3 format. The process of mixing and panning in the frequency domain may, in certain circumstances discussed hereinafter, produce unwanted artefacts.

There are many potential application areas for the process of FIG. 2 and FIG. 3. These include:

PC audio for gaming, user interfaces, teleconferencing, multimedia etc.

Gaming consoles for gaming, web browsing, learning applications etc.

Any device with an audio output where AC3 format would be a useful or functional output.

Sound output from PCs and gaming consoles is mostly 2 channel analog audio. In some systems there is the option of digital output and additional surround channels. The advantages of using an AC3 output are:

Better sound quality. The ability to provide AC3 output is likely to surpass current standards.

True surround format. AC3 is a true surround format offering independent control of each of the 5 channels simultaneously.

Dynamic Range Compression (DRC). The DRC inherent in Dolby Digital decoders could be useful for moderating the dynamic range of game content audio.

Better Surround Content as game authors can exploit the possibility of true surround delivery and AC3 decoders can deal with the actual speaker layouts of the user.

Independent Subwoofer Control.

Single audio connector which carries content for full surround easier setup.

Storage Improvement for sound on games such as the background music is compressed in AC3.

Figure 4:
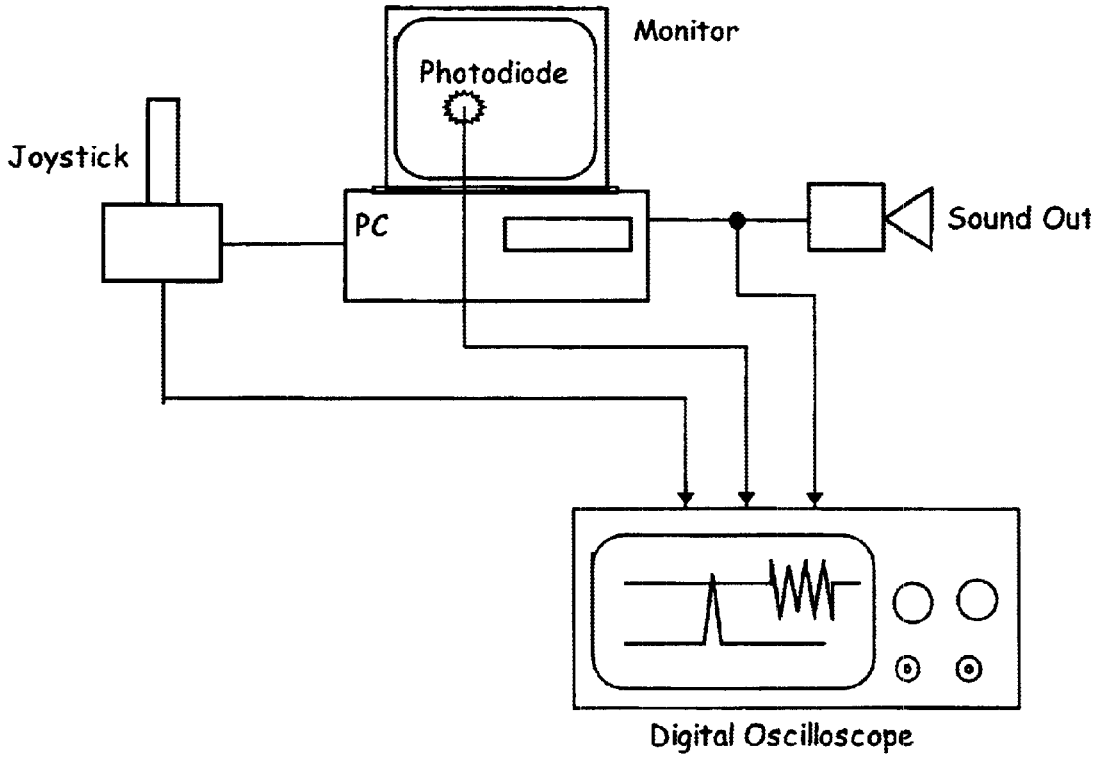
FIG. 4 is a schematic diagram of the experimental setup of the preferred embodiment.

However to be of use as an interactive system, the latency between an event and the time at which audio can be delivered to the user must be ideally sufficiently low to be not particularly noticeable. To determine what is a suitable latency, measurements of a series of latencies of current gaming systems were made. Latency was measured from the user control event (joystick action) to the screen event (detected with a photodiode) and the sound event. The experimental setup was as illustrated in FIG. 4. The results obtained show that audio latencies range from 50 to 300 milliseconds. At the high end of latencies, the audio delay was noticeable and distracting from gameplay. The results obtained were as follows:

| PLATFORM | GAME | FRAME-RATE | VIDEO | AUDIO |
|---|---|---|---|---|
| Pentium PIII-450 32 MB AGP | QuakeIII | 75 Hz P | 38 ms | 80 ms |
| PIII-450 32 MB AGP | Half Life | 75 Hz P | 90 ms | 60 ms |
| PIII-450 32 MB AGP | QuakeII | 75 Hz P | 199 ms | 310 ms |
| Nintendo64 | Turok | 65 Hz I | 195 ms | 105 ms |
| Sony Playstation | Alien | 50 Hz I | 112 ms | 50 ms |

The PC System was running Windows 98 with DirectX 7.0 installed and a Creative SB Live sound card.

Figure 5:
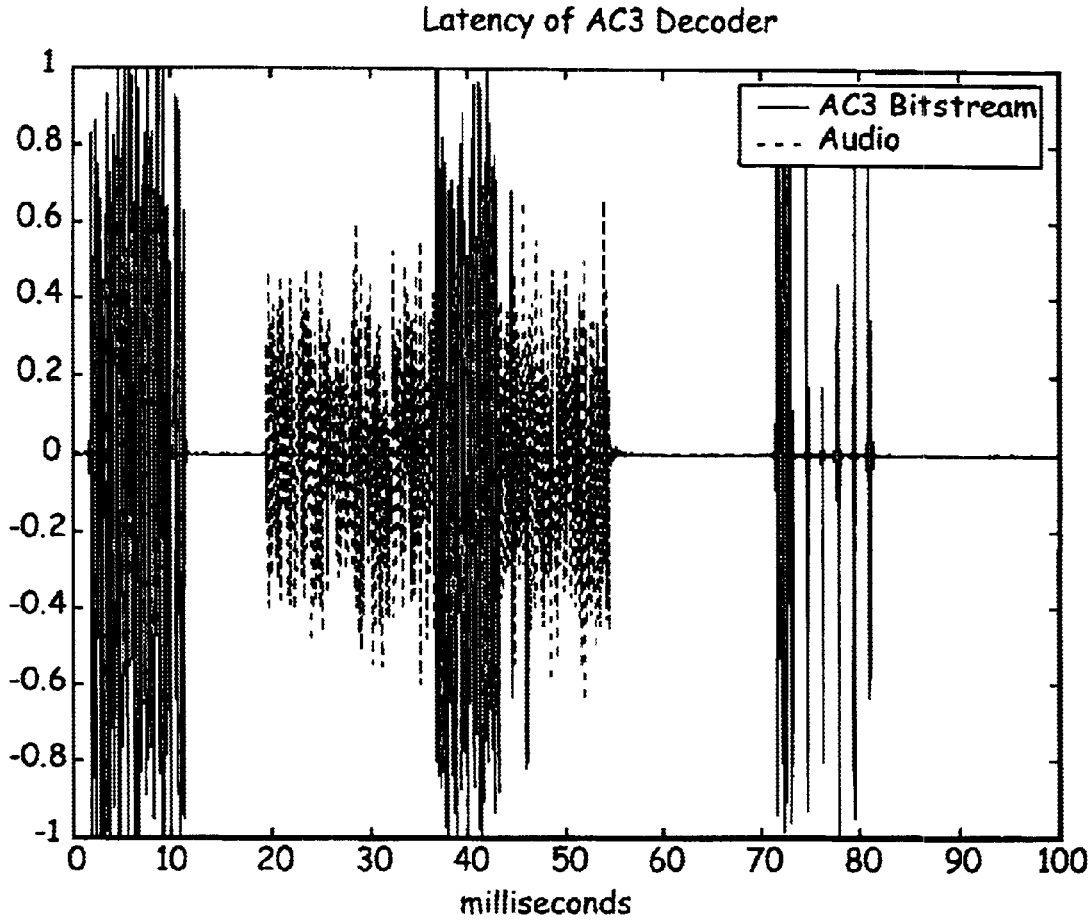
FIG. 5 is a graph illustrating the latency of an AC3 decoder.

A measurement of the latency of an AC3 decoder was made by preparing an AC3 Bitstream encoding a sequence of a 1536 sample noise burst followed by 7 frames of silence. For such a sequence the content sequence of the AC3 frames is easily determined by the nature of the data block envelope. The input and output to the AC3 decoder were sampled simultaneously and are illustrated in FIG. 5. In the AC3 decoder utilised, the DSP was running near 100% CPU thus the decoding processor load of a frame must be spread out over an entire frame period. Since the latency is less than a frame it is evident that the output commences as soon as a single block of a frame is decoded. A model for the decoder latency is proposed

| | | | |
|---|---|---|---|
| | Transmission | 48.BR/SR/SR | 9.4 ms |
| | Block Decoding | BO.PD.256/SR | 8.7 ms |
| SR | Sample Rate | 44.1 kHz | |
| BR | AC3 Bit Rate | 384 kbps | |
| BO | Block Overhead | 1.5 | Variation in block decode load |
| PD | % CPU Used for Decoding | 1.0 | |

This gives a total latency of 18 ms which is consistent with the results. The source was a specially prepared 44.1 kHz AC3 stream on a CD. The decoder was the ZORAN ZR38601.

Producing AC3 output in real time in an interactive environment can be difficult. Typically the AC3 encoding process is processor intensive to produce an efficient compressed audio bitstream. Extremely high quality surround audio can be packed into 384 kbps. Limited media storage or transmission bandwidth often places a constraint on the bandwidth available for audio.

External AC3 decoders are real time with quite low latencies and are designed to handle a maximum output bitrate of 640 kbps with no degradation in performance. Using the highest available bandwidth, the task of creating an AC3 bitstream is simplified somewhat as high quality audio can be delivered at this bitrate using less than optimal compression strategies. Further, when operating in an interactive environment, no storage or transmission constraint need be placed on the interactive AC3 content as it is simply a means of transferring audio from the user's console to an output audio device. Further, in gaming environments, it is not necessary that an AC3 stream be created that gives optimum quality within the 640 kpbs bandwidth, just one that is sufficient in quality to be acceptable for the application.

In order to reduce computational overhead and system latency in say a gaming environment, the gaming audio content will desirably include a pre-processing stage to transform the audio signals into a suitable format. The pre-processing of audio data provides for the creation of a hybrid format (denoted AC3') which is a format of convenience.

As noted previously, the AC3 audio data format is based on a compressed representation of audio data in a frequency sub-band type transform domain. In the aforementioned AC3 literature, this transform is known as the Modified Discrete Cosine Transform (MDCT).

The intermediate format to be used (AC3') is ideally an uncompressed representation of the audio in the MDCT (frequency) domain, along with auxiliary data regarding the likely compression characteristics of each MDCT audio block.

As much as possible, all audio to be used in the game or application will go through a pre-processing stage to create the AC3' format. This processing stage can be done off-line and can be as computationally intensive as required. Much effort can be taken to create information useful for determining how best to compress each audio block on its own, and also how it will be effected by, or will effect the compression of other audio blocks when mixed together. This can be achieved using the information similar to the banded power spectral density information inherent in the AC3 format, however the goal of the AC3' format is to make later compression computationally inexpensive rather than to reduce storage space.

Figure 6:
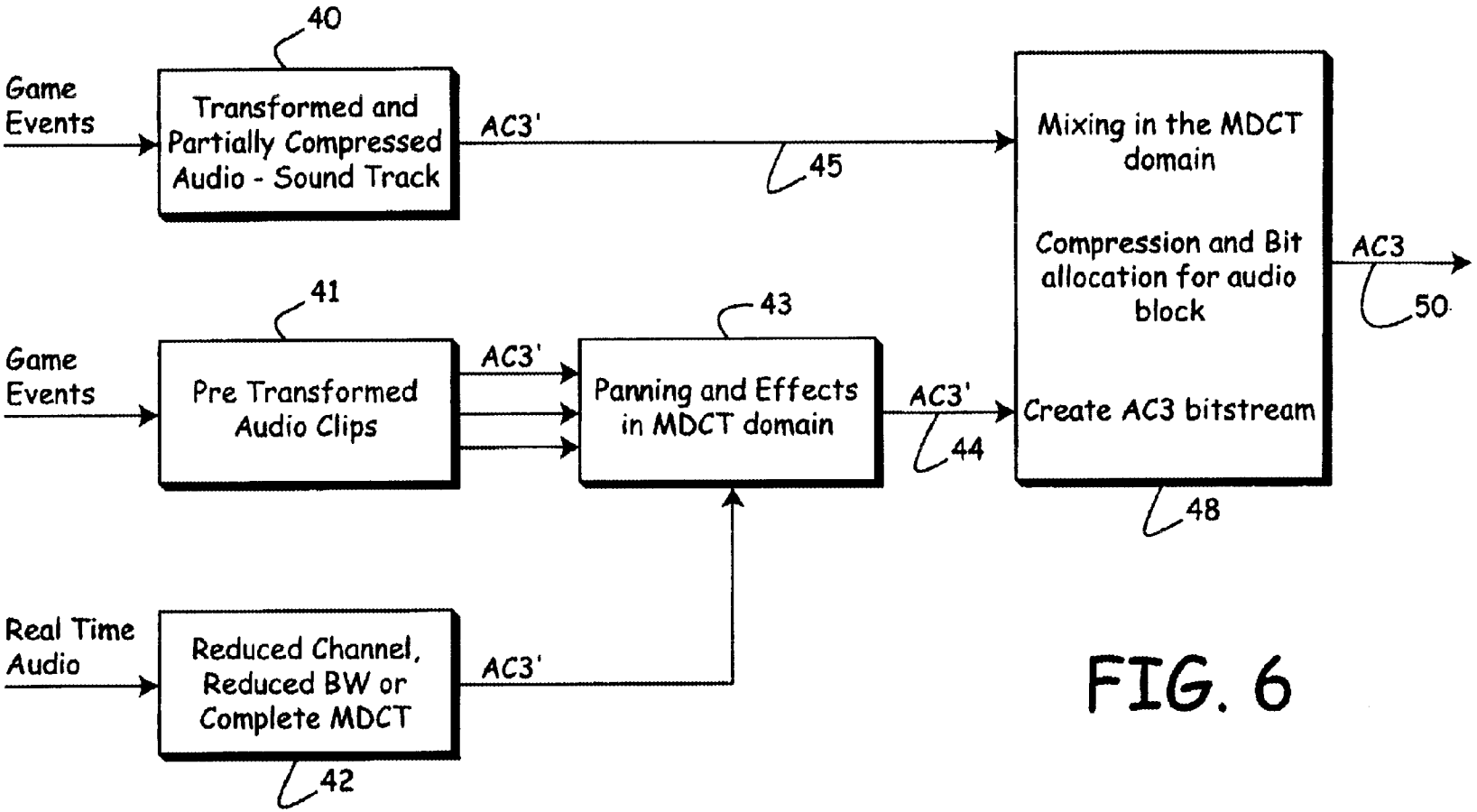
FIG. 6 is a schematic illustration of the mixing process in more detail.

The mixing process can then proceed by selecting and retrieving appropriate AC3' blocks in real time and mixing them together to create actual AC3 audio frames. This is illustrated in FIG. 6 for a game scenario where some game events are transformed and partially compressed 40, other game events trigger the output of pretransformed audio clips 41 and real time audio is manipulated to reduce its bandwidth and transformed into an AC3' format. The outputs from 41, 42 are manipulated 43 to produce an output 44 which is fed with the output 45 to be further mixed in the MDCT domain 48 before a final output 50 is produced.

Figure 7:
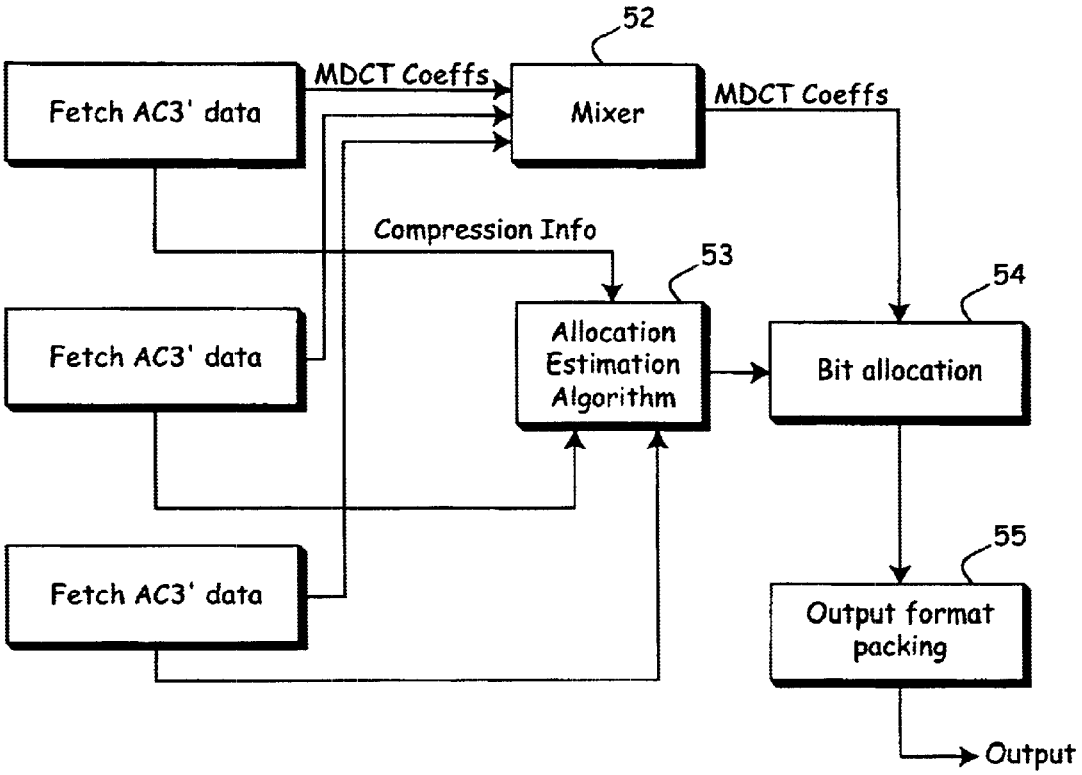
FIG. 7 illustrates the process of mixing intermediate data.

The process of mixing AC3' type data and creating an output is shown in FIG. 7. The MDCT coefficients of each of the input AC3 streams is fed to mixer 52, with the compression information being fed to allocation estimation algorithm 53 which determines bit allocations 54 for output packing 55.

For simplicity, a basic form of the MDCT coefficients are preferably utilised so as to reduce the effects of the AC3 coupling, block splits, bandwidth control and rematrixing. Mixing is a simple operation in the frequency domain as the transform is linear. Due to the above simplification of dealing with the MDCT coefficients in a pure form, it is not necessary to be concerned with the complexities of the compression, bit allocation and coupling aspects of AC3, just the addition of block coefficients in the MDCT domain.

Figure 8:
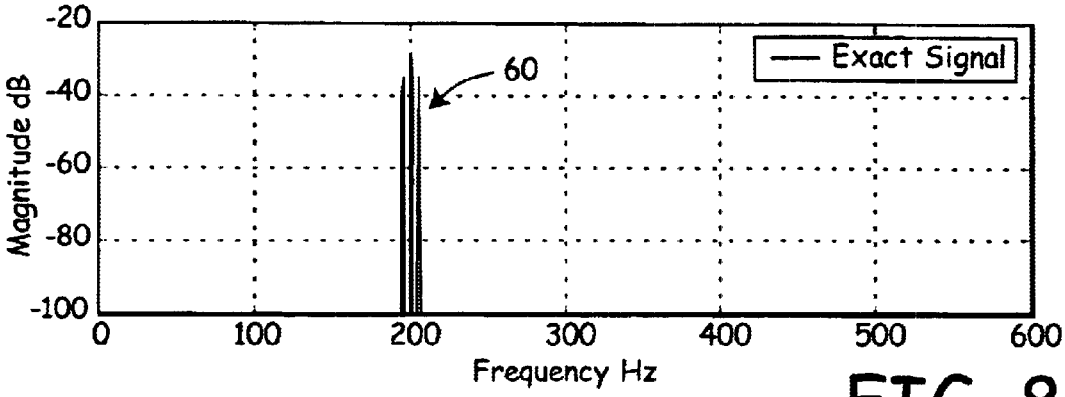
FIG. 8 illustrates the spectrum of a modulated 200 Hz tone.
Figure 9:
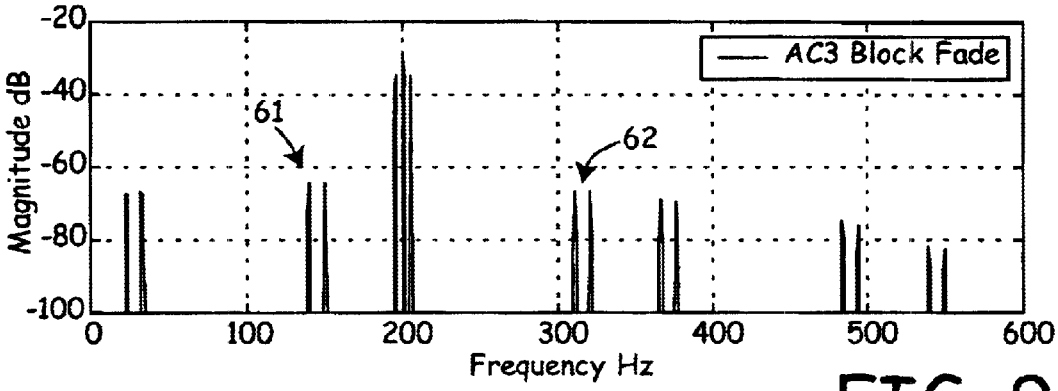
FIG. 9 illustrates the spectrum of FIG. 8 when modulated in the AC3 frequency domain.

Panning operations and/or fading involve discontinuous parameters applied to audio data blocks. The AC3 MDCT has an overlap in the transform domain. However, there is no data redundancy—256 coefficients are created for each new 256 audio samples. Since it is not a redundantly overlapped transform, blocking artifacts will occur where scaling parameters are changed between successive blocks. Audio tests were found to demonstrate this effect. For broadband signals (music, voice) and reasonable fade rates (e.g. 200 milliseconds) the artifacts were not noticeable as being masked by signal content. For signals with a high pure tone content and faster fades (100 ms) the artifacts can become noticeable and some-what undesirable. For example, in FIG. 8 there is illustrated 60 the spectrum of a 200 Hz tone modulated by a 5 Hz raised cosine (corresponding to a 100 ms period for fading in or out). The undesirable side bands 61, 62 produced by a block scaling are shown in FIG. 9.

Figure 10:
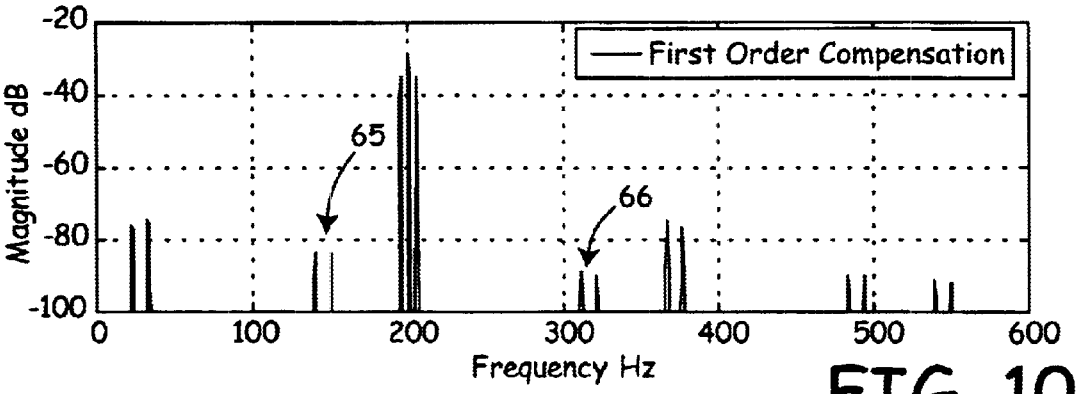
FIG. 10 illustrates a compensated spectrum which includes first order compensation.

Techniques can be implemented to reduce the side bands. In a first example, the results of which are shown in FIG. 10, first order compensation (requiring three MACs) was used to reduce the main offending side bands 65, 66 by nearly 20 dB. Hence, rather than simple multiplication for scaling of the blocks, three multiply-accumulates for each MDCT bin can be used to partially correct for the discrete gain change.

This process may correct the MDCT coefficients by amounts that are less than the AC3 quantisation thresholds due to the masking curves. In this case it could be argued that the changes and thus the noise could not be heard in the first place. However, experiment has shown the noise to be noticeable therefore the correction should fall above the AC3 thresholds (which should closely match the masked hearing thresholds).

If we could introduce a gain change over the block then due to wrapping of the ends of each block, we can only really control the gain in the middle of the block (between ¾ and ¼). However the lack of control to edge of blocks can be compensated for by using a window function. A low grade gain across a block can be implemented as a circular frequency convolution of only a few taps (small side band on the DC gain). In fact quite a good approximation would be a DC gain plus a single sine which can be implemented as a two point convolution in the IMDCT domain. Such an arrangement was found to provide for a substantial reduction in noise levels.

To implement the smooth cross fade, the basis function at the 256 point block is a raised cosine (K+cos θ). Over an unwrapped 512 sample block this is more like a raised full sine wave. Now such a function does not easily map to a basis of the AC3 space as the AC3 functions are strictly 0 at 127.5 and 1 at 383.5. Also the simple DC input is not a simple basis combination in AC3. Ideally a simple convolution kernel in the AC3 domain should be provided which produces a raised cosine multiplication on the time domain data.

Considering the operator analogies between the two domains:

| TIME DOMAIN | AC3 DOMAIN |
|---|---|
| OP X (.x) | $\hat{x}$ (convolution with wrapping) |
| $\chi \times 1 = \chi$ | $\chi \hat{x} 1 = \chi$ |

Now in normal convolution enabling transforms T(1)=1

However $T(1) \neq 1$ & $T^{-1}(1') \neq 1$

So to find the convolution kernel in the AC3 domain that we will need to apply a time domain window $W=T(w \times T^{-1}(1'))$. Now for $$w(t) = \sin\frac{(0.5:511.5\ 2\pi)}{512}$$

If we further define 1'(Δ) as a convolution offset by Δ, then $$T(W \times T^{-1}(1'(0)))=[-0.5,-0.5,0,0, \ldots]$$

$$T(W \times T^{-1}(1'(1)))=[-0.5,0,-0.5,0, \ldots]$$

$$T(W \times T^{-1}(1'(2)))=[0,-0.5,0,-0.5, \ldots]$$

$$T(W \times T^{-1}(1'(225)))=[0, \ldots ,-0.5,0.5]$$

Note that it is not immediately obvious but the convolution of AC3 domain is slightly modified. In that the kernel of [0,−0.5] is applied to the following data

[X(255:−1:0)X(0:255)−X(255:−1:0)]

Another way of viewing this is a kernel of [−0.5, 0, −0.5] with terms falling of the bottom end wrapped back in positive end and terms falling of the top end wrapped back in negative end. The end result is the following algorithm:

To fold AC3 blocks together with fading.

$G_{-1}$=gain of previous block $G_0$=gain for this block $G_1$=gain for next block Thus over the samples of interest we want to apply the function:

$$\frac{G_{-1}+2G_o+G_1}{4}+\frac{G_{-1}-G_1}{4}\sin\left[\frac{(128.5:383.5\ 2\pi)}{512}\right].$$

This gives the required kernel:

$$\left[\frac{G_{-1}-G_{-1}}{4}, \frac{G_{-1}+2G_o+G_1}{4}, \frac{G_{-1}-G_{-1}}{4}\right].$$

which we can then apply in the AC3 domain as $$Y(0)=\frac{+2G_0+2G_1}{4}X(0)+\frac{G_{-1}-G_{-1}}{4}X(1),$$

$$Y(n)=\frac{G_{-1}-G_{-1}}{4}(X(n-1)+X(n+1))+\frac{G_{-1}+2G_o+G_1}{4}X(n) \text{ for } n = 1 \text{ to } 254, \text{ and } Y(255)=\frac{2G_{-1}+2G_o}{4}X(255)+\frac{G_{-1}-G_{-1}}{2}X(254).$$

The MDCT transform was found to be fairly robust to discontinuous parameters effecting the transformed data. It is also reasonably tolerant to slight perturbations of the signal frequency spectrum.

One of the main effects required for gaming and simulation is the ability to reduce the bandwidth of a signal. This is required for simulating both air attenuation and object occlusion. Simple low pass windowing in the MDCT frequency domain provides a means of reducing the bandwidth without introducing significant artifacts.

Other effects are possible. Obviously since mixing is possible, echoes and delays of an integer number of audio blocks (256 samples) are trivial. The lack of a data redundancy in the MDCT transform makes it impossible to do true convolution or fractional block delays, however some 'convolution' effects can be created by frequency domain multiplication. Although these effects are not linear, they can create interesting sounds. In this way the properties of the transform could be exploited to make other effects—what is considered as noise or error by some could be a desirable sound to others.

Figure 11:
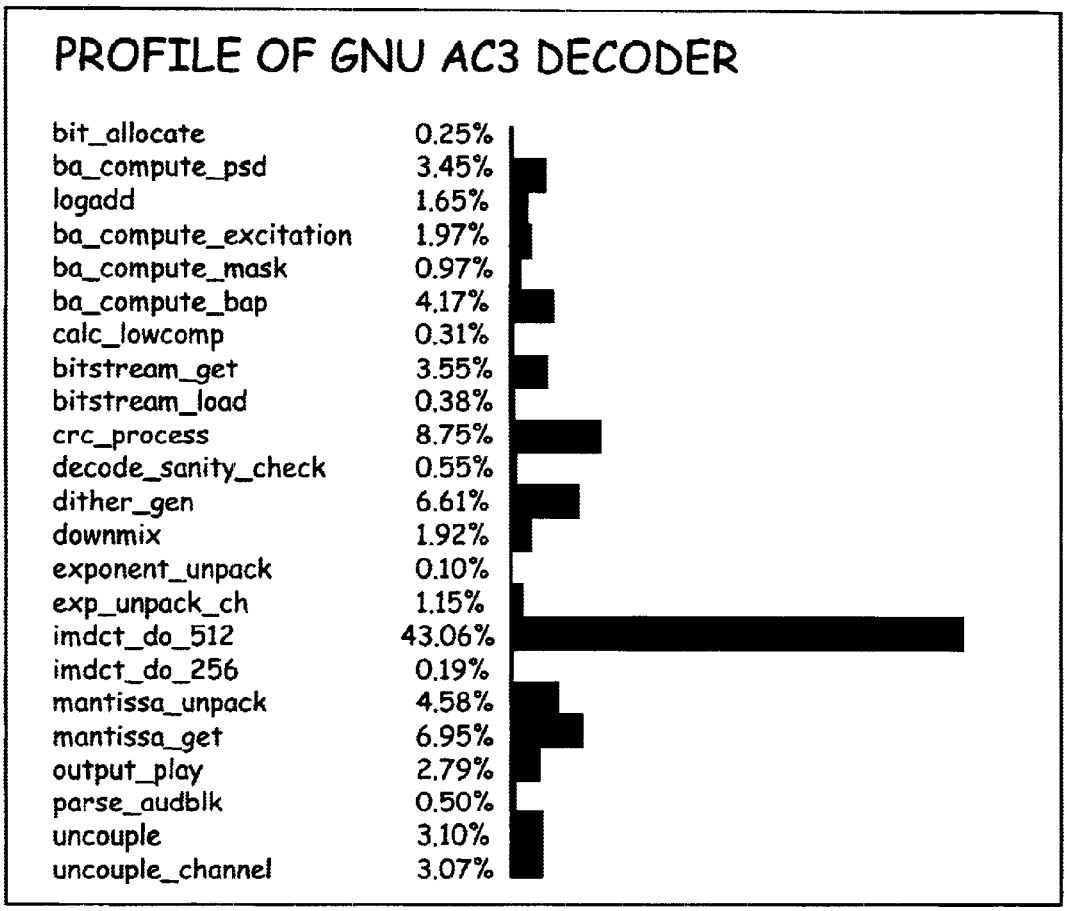
FIG. 11 illustrates the profile of the execution of an AC3 decoder.

Working on the audio in the transform domain is only efficient when the alternative of converting back to the time domain for all mixing and effects operations is significantly more computationally expensive. A profile of a GNU AC3 decoder was taken to give an indication of the time taken in the MDCT transforms in relation to the bit allocation and remainder of the AC3 algorithm. This profile is shown in FIG. 11 and illustrates the large computational overload of the transform process. For this decoder the IMDCT is the largest single stage in the process and is responsible for close to half of the processor load. This suggests that the ability to combine and manipulate audio data in the MDCT domain is highly effective when compared to transforming back to the time domain.

The above process, whilst perhaps not creating the optimal AC3 bit stream in real time, provides a means for creating an AC3 bit stream at 640 kbps which has sufficient audio quality for most applications. Using the maximum allowable bit rate for standard external decoders of 640 kbps can give a substantial additional data rate for less than optimal bit allocations.

To reduce computational requirements, many games use sampling rates less than 48 kHz and often word length for audio samples less than 20 bit. This indicates that the acceptable level of sound quality for interactive applications is not as high as the movie surround audio application AC3 was developed for increasing the estimate of available non-optimal bit allocation overhead.

An estimation of the system audio latency has been made. This is the time from when an event occurs within the gaming system to the time that the AC3 decoder produces an appropriate sound. The following table gives estimate formulae for the latency calculation. All of the independent variables are described and given a typical value below.

| LATENCY COMPONENT | FORMULA | VALUE |
|---|---|---|
| Framing Latency | 1536/SR | 32 ms |
| Frame Construction Time | 1536.PE/SR | 16 ms |
| Digital Audio Output Latency | LA | 40 ms |
| Transmission | 48.BR/SR/SR | 13 ms |
| Block Decoding | BO.PD.256/SR | 8 ms |
| Block Overlap | 256/SR | 5 ms |
| Buffering and D to A Conversion | DA | 2 ms |
| TOTAL | | 116 ms |

| | | |
|---|---|---|
| SR | Sample Rate | 48 kHz |
| PE | % CPU Used for Encode | 0.5 |
| BR | AC3 Bit Rate | 640 kbps |
| BO | Block Overhead | 1.5 |
| PD | % CPU Used for Decoding | 1.0 |

Using this model, a range of typical values were used for the independent variables for both PC and console type systems. Latencies were in the range of 70 to 150 ms.

Since the desired output of the system is an AC3 bitstream which contains a compressed representation of the audio in the MDCT domain, having all audio data for a game pre-transformed to this format will provide significant computational savings. In new games, particularly on DVD there will not be a strong requirement to have all game sounds compressed. Thus an uncompressed AC3 type audio format with the uncompressed MDCT coefficients and some information regarding suitable exponent, masking and bit allocation strategies for the audio data can be easily used.

If all audio is pre-transformed, audio samples can be loaded mixed and manipulated in the MDCT domain. This reduces the computation required for the AC3 encoding to developing a suitable exponent, masking and bit allocation strategy for the combined MDCT data. Furthermore, since there are no time requirements on the pre-transformation stage for audio samples, more elaborate data can be derived from the transformed data.

As noted previously, the result of all effects processing and mixing will be a set of audio channel information in the MDCT domain. The final stage of the AC3 generation process involves taking these coefficients and compressing them into a bit stream. This involves deciding bandwidth, coupling, exponent, rematrixing and masking curve strategies. The final stage must trade off how much compression to apply so that the bandwidth constraints of the bitstream are met against maintaining a high audio quality.

For real time operation without excessive computation the final stage should be able to estimate a set of the compression parameters so that the bitstream can be created in a single pass. Iteration of the compression to achieve optimal results may not be feasible given the processor constraints.

A single pass encoder can be implemented as follows:

Use information from a variety of sources to suggest or estimate a suitable set of compression parameters to meet the bandwidth constraint and maintain audio quality.

Have a set of techniques to quickly sacrifice bandwidth should such a situation occur where to add to the bitstream with the suggested parameters would lead to a bit allocation overflows. Such techniques should be able to be implemented with minimal recalculation of the bit allocation and changes that can be applied to the compressed bitstream still pending transmission. Where the output data falls below the required bit rate it will need to be padded.

The possible sources of information to be used to estimate suitable compression parameters can include:

Efficiency of previous block's compression as the last block of audio is often a very good estimate of the next in terms of signal characteristics.

Precomputed bit allocation information and suggested exponent strategies. The complexity of the calculations required for this information is not bounded as it will be carried out in non-real time.

Precomputed audio signal statistics to determine when to change strategies.

Simple real time audio signal statistics to identify change points

Precomputed information from future audio blocks to estimate future bit allocation demand. For example if it is known that the next few blocks will be fairly low signal content more bits can be used for current blocks.

Frequency banded information to help determine how mixing two signals will effect the masking and compression.

The remaining bit allocation space in a given frame and suggested average bit allocations for blocks within a frame.

Some strategies for eliminating data can include:

Sudden bandwidth reduction on individual channels

Sudden bandwidth reduction on the coupling channel

Lowering the input of the coupling channel

Increasing or decreasing the SNR thresholds by a full bit (full bit changes reduces the recomputation of bit allocations).

Other refinements of the single pass encoder can include strategies for monitoring the bit allocation across an entire frame (6 audio blocks) and suggesting suitable allocation of the frame bandwidth across the 6 blocks. This might include limiting the retransmission of exponent data and techniques for limiting or saturating values within the set exponents of a frame without excessive distortion. It is also likely that to avoid complexity a single pass encoder can fix some of the compression parameters to reduce the possible search space for a good compression regime. Although fixing some of the parameters will force the bitstream to be less than optimal, this can be justified by the reduction in complexity of the algorithms involved in estimating suitable parameters.

Figure 12:
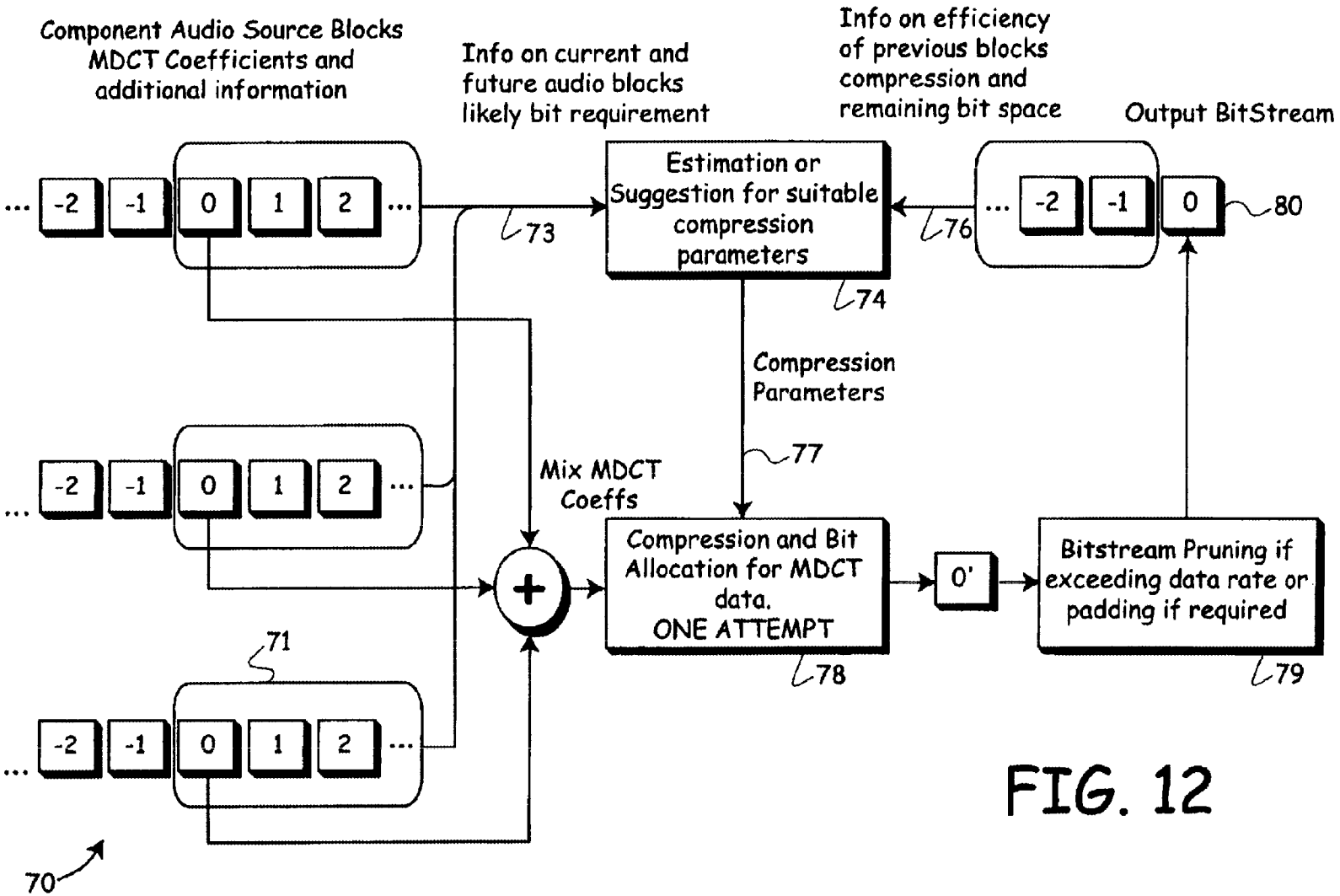
FIG. 12 illustrates one form of one pass encoding of an AC3 stream.

FIG. 12 illustrate a schematic of the information flow and processes involved in the single pass encoder. The component audio source blocks are input 70 one at a time with a window being kept for each input audio source. The coefficients are mixed 72 and the information of current and future audio blocks likely bit requirements is forwarded 73 to an estimation unit 74. The estimation unit 74 also receives information of the efficiency of previous blocks compression and remaining bit space 76. This information is used by unit 74 to determine a series of compression parameters 77 for compressing and bit allocating the mixed coefficients 78 which arc subsequently pruned or padded if required 79 before being output 80.

It will be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art can be made thereto, without departing from the scope of the present invention.

What is claimed is:

1. A method of combining a plurality of different input audio signals, each including a plurality of channels to create an audio output signal from said plurality of input audio signals, said method comprising:

(a) for each of said plurality of input audio signals, precomputing to form a corresponding transform domain input signal and a corresponding associated set of input masking data;

(b) mixing together said transform domain input signals in the transform domain to produce an output transform domain signal;

(c) mixing together said sets of masking data in the transform domain to produce an output set of transform domain masking data;

(d) quantizing said output transform domain signal with said output transform domain masking data; and (e) outputting said quantized output transform domain signal.

2. The method as claimed in claim 1, wherein said mixing together said transform domain input signals includes fading one or more of said transform domain input signals.

3. The method as claimed in claim 2, wherein said fading includes suppressing noise associated with said fading process.

4. The method as claimed in claim 3, wherein said suppressing includes a first order compensation for said noise.

5. The method as claimed in claim 1, further comprising:

(f) transforming in real-time a real-time audio stream and mixing said real-time audio stream with said transform domain input signals in said mixing together said transform domain input signals.

6. The method as claimed in claim 1, wherein said quantized output transform domain signal is in the format of AC3 encoded data or MPEG audio encoded data.

7. The method as claimed in claim 1, wherein said audio output signal is created as a series of blocks of data output one at a time and said method includes adaptively determining compression parameters for said output blocks.

8. A method of creating a compressed audio output signal from a plurality of different input audio signals, each including a plurality of channels, the method comprising:

a) for each of said input audio signals, precomputing a transform corresponding to a desired compression format of said output audio signal;

b) for each of said input audio signals, precomputing ancillary information relating to the compression of the transformed output audio;

c) mixing together said transformed input signals in the transform domain to produce an output transform domain signal;

d) algorithmically combining together said precomputed ancillary information to determine a suitable decompression strategy; and e) outputting compressed audio data comprising said output transform domain signal and said combined ancillary information, wherein said ancillary information includes at least one of the set consisting of:

bit allocation information, suggested exponent strategies in the case the decompression includes exponent strategies, audio signal statistics to determine when to change strategy, information providing an indication of future bit allocation demand, frequency banded information for determining how mixing will effect masking in the case the compression uses masking, and in the case an input audio signal is divided into frames of data, the remaining bit allocation in a frame and a suggested average bit allocation for data within the frame.

9. The method as claimed in claim 8, wherein said ancillary information comprises at least one of the following: signal banded power spectrum, exponent groupings or psycho acoustic masking curves.

10. The method as claimed in claim 9, wherein said algorithmically combining includes determining desirable quantization levels of said output transform domain signal.

11. A method of creating a compressed audio output signal from a plurality of different input audio signals, each including one or more audio channels, the method comprising:

a) mixing together representations in the transform domain of a plurality of input signals, the mixing in the transform domain to produce an a representation of the output signal, each transform domain representation precomputed for a corresponding one of the plurality of different input audio signals;

b) algorithmically combining together auxiliary information related to each input signal whose representations are mixed in the mixing step, the algorithmic combining to determine a suitable decompression strategy; and c) outputting compressed audio data comprising said output transform domain signal and said combined auxiliary information, wherein the plurality of representations of the input signals in the transform domain are obtained by, for each of the input signals whose representations are mixed, precomputing a transform corresponding to a desired compression format of said output audio signal, wherein the auxiliary information of each of the input signals whose representations are mixed is obtained by precomputing the auxiliary information related to the desired compression format, the auxiliary information including one or more precomputing steps of the set of precomputing steps consisting of:

precomputing bit allocation information, precomputing suggested exponent strategies in the case the decompression includes exponent strategies, precomputing audio signal statistics to determine when to change strategy, precomputing information providing at any point in time an indication of future bit allocation demand, the information precomputing using future audio information, precomputing frequency banded information to provide for determining how mixing will effect masking and compression in the case the compression uses masking, and in the case an input audio signal is divided into frames of data, precomputing for a frame the remaining bit allocation space in the frame and the suggested average bit allocations for data within the frame.

* * * * *

UNITED STATES PATENT AND TRADEMARK OFFICE

CERTIFICATE OF CORRECTION

PATENT NO. : 6,687,663 B1
DATED : February 3, 2004
INVENTOR(S) : McGrath et al.

It is certified that error appears in the above-identified patent and that said Letters Patent is hereby corrected as shown below:

Title page,
Item [74], *Attorney, Agent or Firm*–, please change "Inventels" to -- Inventek --.

Column 7,
Lines 18 and 19, change " $\hat{x}$ " to --⊗--.

Column 8,
Lines 3-4, change " $Y(0) = \frac{+2G_o + 2G_1}{4} X(0) + \frac{G_1 - G_{-1}}{4} X(1)$
to -- -- $Y(0) = \frac{+2G_o + 2G_1}{4} X(0) + \frac{G_1 - G_{-1}}{2} X(1)$ --.

Column 10,
Line 45, change "illustrate" to -- illustrates --.
Line 57, change "arc" to -- are --.

Signed and Sealed this

First Day of June, 2004

JON W. DUDAS
*Acting Director of the United States Patent and Trademark Office*